US006474964B2

(12) United States Patent
De Bernardi et al.

(10) Patent No.: US 6,474,964 B2
(45) Date of Patent: Nov. 5, 2002

(54) SCROLL COMPRESSOR WITH DEFLECTOR PLATE

(75) Inventors: Jean De Bernardi, Lyons (FR); Pierre Ginies, Sathonay Village (FR)

(73) Assignee: Danfoss Maneurop A.S., Trevoux (FR)

( * ) Notice: Subject to any disclaimer, the term of this patent is extended or adjusted under 35 U.S.C. 154(b) by 0 days.

(21) Appl. No.: 09/836,823

(22) Filed: Apr. 17, 2001

(65) Prior Publication Data

US 2001/0055536 A1 Dec. 27, 2001

(30) Foreign Application Priority Data

Apr. 27, 2000 (FR) ..... 00 05418

(51) Int. Cl.[7] ..... F01C 1/02

(52) U.S. Cl. ..... 418/55.6; 418/100; 417/410; 417/312

(58) Field of Search ..... 418/55.6, DIG. 1, 418/100; 417/410, 312

(56) References Cited

U.S. PATENT DOCUMENTS 5,055,010 A * 10/1991 Logan ..... 418/55.6
5,114,322 A * 5/1992 Caillat et al. ..... 418/55.6
5,219,281 A * 6/1993 Caillat et al. ..... 418/5.6
5,240,391 A * 8/1993 Ramshankar et al. ..... 418/55.6
5,366,352 A * 11/1994 Deblois et al. ..... 417/292
RE35,216 E * 4/1996 Anderson et al. ..... 418/55.4

* cited by examiner

*Primary Examiner*—Thomas Denion
*Assistant Examiner*—Theresa Trieu
(74) *Attorney, Agent, or Firm*—Lee, Mann, Smith, McWilliams, Sweeney & Ohlson

(57) ABSTRACT

A scroll compressor having a cylindric hermetically closed shell, a suction chamber within the shell, a scroll mechanism in the shell, lubrication mist generating elements, a suction gas inlet opening radially into the suction chamber and a deflector plate in overlying relationship with the suction gas inlet and cooperating with the shell to delimit a duct having at least an upper opening feeding suction gas to the scroll mechanism. To uniformly laden the suction chamber with sufficient oil, the upper opening is shaped to deflect suction gas into a region within the suction chamber where an oil mist is generated by the mist generating elements during operation.

10 Claims, 2 Drawing Sheets

SCROLL COMPRESSOR WITH DEFLECTOR PLATE

BACKGROUND OF THE INVENTION

The subject of the present invention is a scroll compressor equipped with deflector plate opposite the gas inlet orifice of its shell.

A scroll compressor comprises a hermetically sealed shell inside which are formed a suction chamber with an inlet for the gas and a discharge chamber or pressure chamber. The suction chamber and the discharge chamber are separated by a separating wall. A pump is intended to raise the pressure of the suction gas consists of two scrolls: a stationary scroll secured to the separating wall and a moving scroll driven by a shaft of an electric motor mounted inside the suction chamber. The moving scroll is off-centred with respect to this shaft so as to describe an orbital movement and delimit, with the stationary scroll, as the shaft rotates, pockets of varying and increasingly small volume in which the gas is compressed before escaping through an orifice towards the discharge chamber.

Because there are functional clearances between the stationary scroll and the moving scroll which together delimit the pockets in which the gas is compressed, it is necessary for the gas let into the pockets to be slightly laden with oil so that this oil can seal between the pockets to achieve reasonable compression during operation of the compressor.

It would therefore be desirable for the gas let into the suction chamber to be able to become uniformly laden with oil to a sufficient degree so as to optimize this sealing.

It is known practice, particularly from document U.S. Pat. No. 5,055,010, for a scroll compressor to be fitted with a deflector arranged inside the suction chamber opposite the gas inlet thereinto. Such a deflector is intended to distribute the stream of gas towards the two inlets of the compression stage, increasing the performance of the compressor in terms of energy consumption by allowing some of the gas to pass directly into the compression stage.

However, an arrangement of this type is not able to solve the problem which consists in allowing the gas to become uniformly laden with oil particles at the two inlets to the compression stage. This is because although the proportion of the stream of gas which is deflected towards the bottom of the compressor by the deflector follows a lengthy path inside the compressor within the suction chamber, allowing it to become laden with oil, the proportion of the gas which is deflected directly towards the compression stage does not become laden with oil, or becomes laden with very little oil, when there is a suction effect between the deflector and the inlet to the compression stage located above the deflector.

SUMMARY OF THE INVENTION

The object of the invention is to provide a scroll compressor equipped with a deflector opposite the gas inlet orifice to the suction chamber, the gas conveyed to the compression stage becoming more or less uniformly laden with oil particles.

This object is solved by providing a scroll compressor having a cylindric hermetically closed shell, a suction chamber within the shell, a scroll mechanism in the shell, lubrication mist generating elements, a suction gas inlet opening radially into the suction chamber and a deflector plate in overlying relationship with the suction gas inlet and cooperating with the shell to delimit a duct having at least an upper opening feeding suction gas to the scroll mechanism characterized in that the upper opening is shaped to deflect suction gas into a region within the suction chamber where an oil mist is generated by said mist generating elements during operation.

Preferably, the means generating an oil mist are constituted by a counterweight secured to the shaft of the motor and located in the suction chamber.

The proportion of the stream of gas directed by the deflector towards the compression stage does not flow directly towards this compression stage but is returned towards the inside of the suction chamber where the gas becomes laden with oil particles.

According to one embodiment of this device, the compression-stage end of the deflector has a L-shaped return which deflects the stream of gas through 180°.

Advantageously, the end of the L-shaped return is located approximately in the same plane as the upper edge of the duct formed by the deflector.

This arrangement thus creates a baffle effect.

According to one feature of the device according to the invention, the deflector consists of a part of overall Ω-shaped cross section, the flanges of which are used for securing it to the internal face of the shell approximately parallel to the axis of the compressor, and the body of which delimits the duct conveying the gas towards the inside of the suction chamber.

According to one embodiment of the invention, the duct delimited by the deflector is also delimited by a recess made in the inner face of the shell of the compressor.

Preferably, the duct has an upper opening and a lower opening and comprises two parts, of which the one facing towards the compression stage has a smaller cross section than the one facing towards the motor.

To achieve good distribution of the flows, the gas inlet orifice opens into the part of the duct of larger cross section facing towards the motor, the section-reducing zone providing the transition between the two parts of the duct being offset towards the compression stage with respect to the inlet orifice.

According to one embodiment of this device in its small cross section zone facing towards the compression stage, the deflector has a flat central surface whereas, in its large cross section zone facing towards the motor, the deflector has a central surface in the shape of a portion of a cylindrical surface.

According to another feature of the invention, the length of the deflector is such that this deflector extends on each side of the inlet orifice over a distance at least equal to the diameter of the inlet orifice.

BRIEF DESCRIPTION OF THE DRAWINGS

In any event, the invention will be clearly understood with the aid of the description which follows, with reference to the appended diagrammatic drawing which, by way of nonlimiting example, depicts one embodiment of a scroll compressor equipped with this suction device.

DETAILED DESCRIPTION OF THE INVENTION

Figure 1:
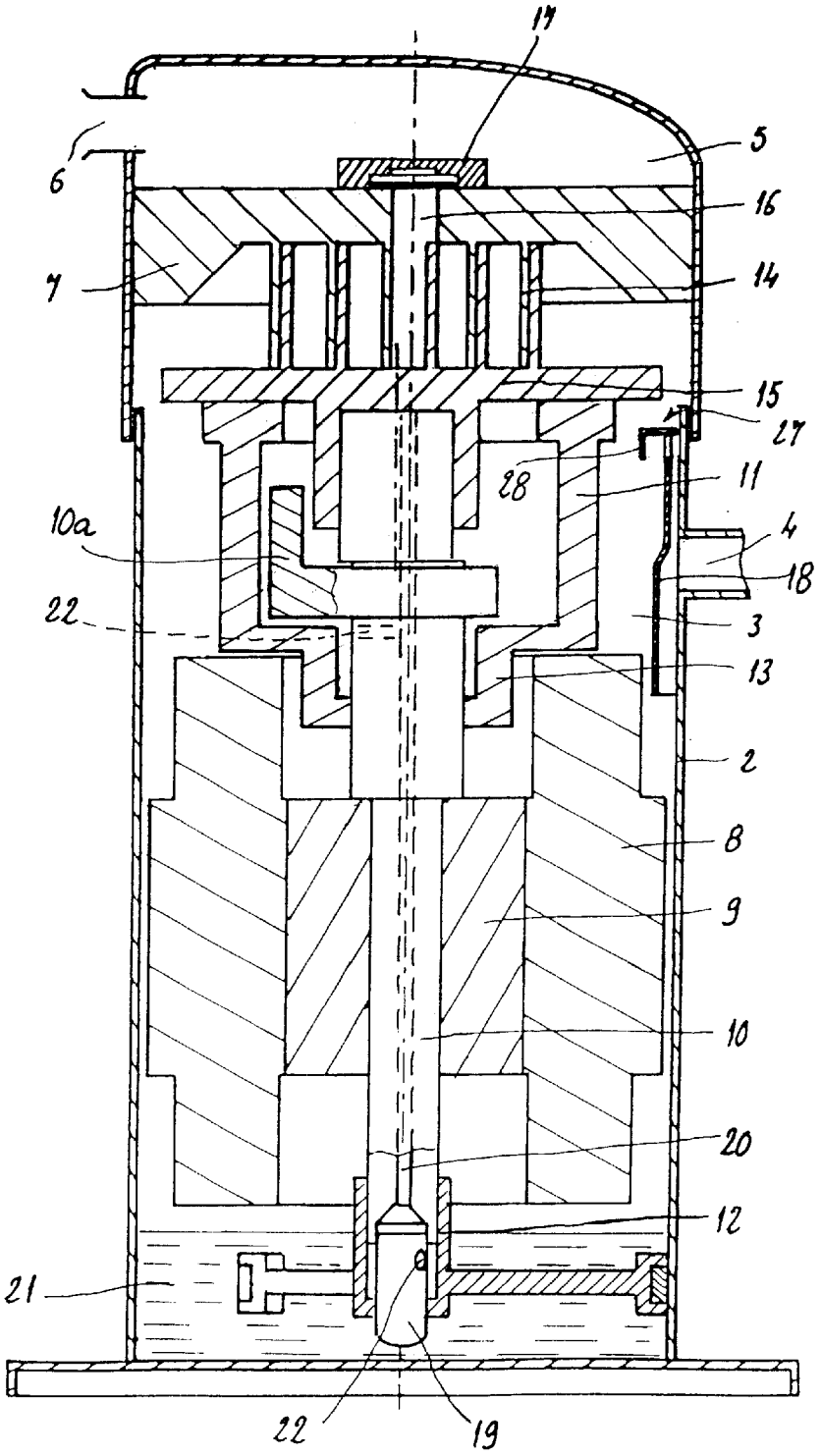
FIG. 1 is a view in longitudinal section of a scroll compressor equipped with this device.
Figure 2:
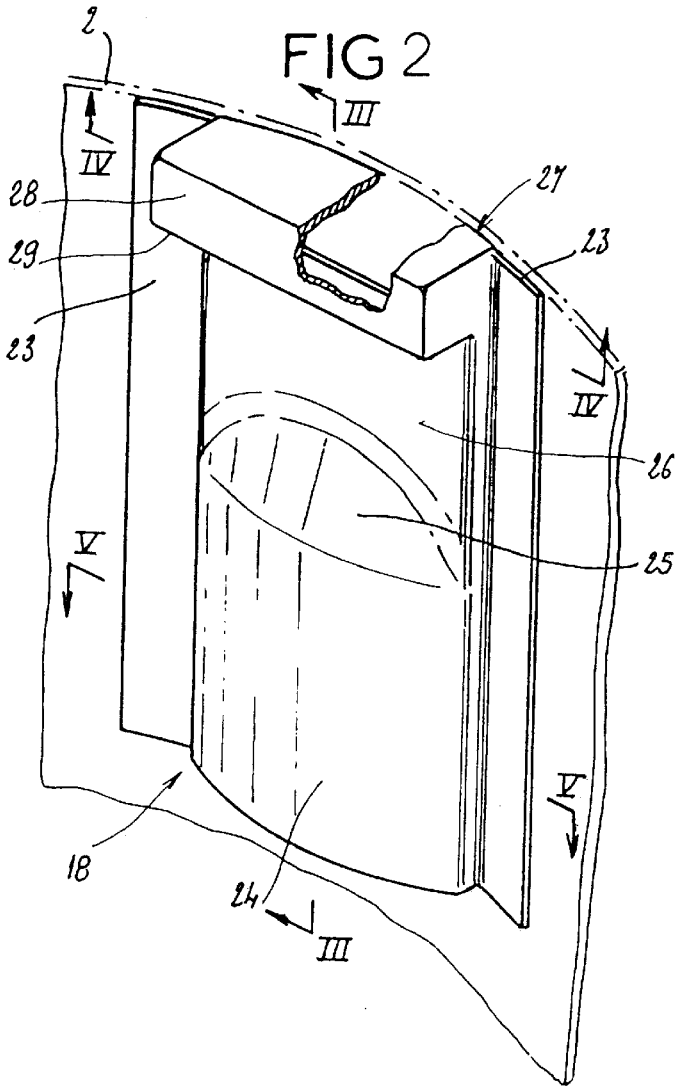
FIG. 2 is a view in perspective with partial cutaway of a deflector which forms part of the device according to the invention, in a position mounted inside the casing of a compressor.
Figure 3:
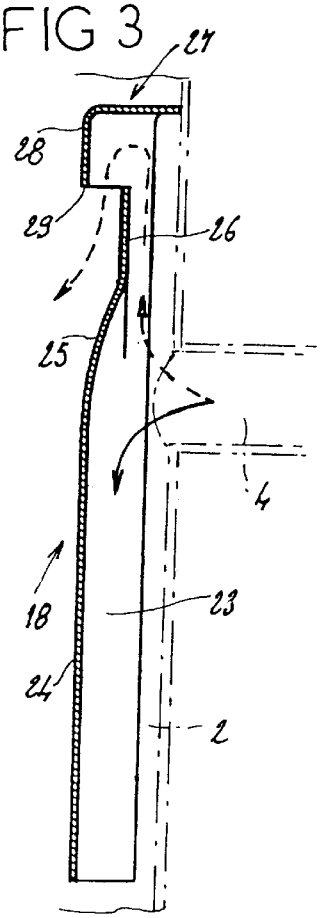
FIG. 3 is a view in longitudinal section of the deflector on the line III—III of FIG. 2.
Figure 4:
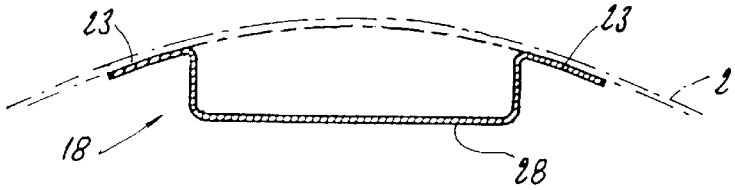
FIGS. 4 and 5 are two views in cross section along the lines IV—IV and V—V of FIG. 2, respectively.
Figure 5:
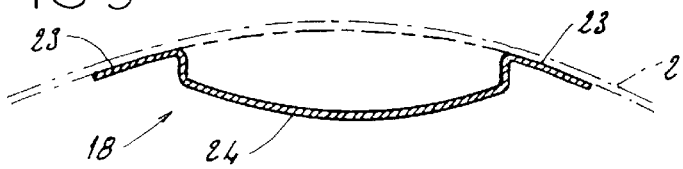

The scroll compressor is depicted in FIG. 1 comprises a hermetically sealed shell 2 inside which are formed a suction chamber 3 with an inlet 4 for the gas and a discharge chamber or pressure chamber 5 with an outlet 6 for the gas. The suction chamber 3 and the discharge chamber 5 are separated by a separating wall 7. Mounted inside the suction chamber 3 is an electric motor, the stator 8 and the rotor 9 of which are depicted diagrammatically in the drawing. The rotor 9 is associated with a shaft 10 passing through a body 11 of the compressor and guided in rotation in a lower bearing 12 and at least one upper bearing 13. The pump is intended to raise the pressure of the suction gas consists of two scrolls: a stationary scroll 14 secured to the separating wall 7 and a moving scroll 15 driven by the motor shaft 10 and off-centred with respect to this shaft so as to describe an orbital movement and delimit, with the stationary scroll, as the shaft rotates, pockets of varying and increasingly small volume in which the gas is compressed before escaping through an orifice 16 towards the discharge chamber 5. A valve system denoted by the general reference 17 is mounted on the outlet 16 so as to allow the gas to pass into the pressure chamber 5 and prevent the gas from passing from this same chamber 5 into the suction chamber 3 when the compressor is not running. In the bottom of the compressor there is a layer of oil 21 in which is submerged a pump 19 secured to the shaft 10 and intended, via an oilway 20 inside the shaft, to supply the bearings in which this shaft 10 is guided with oil so as to lubricate them. Oil is supplied from the oilway 20 to the bearings via distribution ports 22. The bearing lubrication oil emerges in the form of an emulsified mist and is sprayed, under the action of an upper counterweight 10*a* secured to the shaft 10, inside the enclosure which constitutes the suction chamber 3, on account of the presence of a number of openings formed in the body 11.

This compressor is equipped, opposite the gas inlet orifice 4, with a deflector 18. This deflector 18 has a cross section in the shape of an Ω, comprising two longitudinal flanges 23 intended for attachment to the face of the inner casing 2, parallel to the axis of the compressor. The flanges 23 are connected, in one part of the deflector, by a curved central surface 24 in the shape of a portion of a cylindrical surface, and in another part of the deflector, by a flat surface 26. These two surfaces are connected by an inclined zone 25. The deflector 18 delimits, with the hermetically sealed casing, a duct comprising a first part facing towards the compression stage, and delimited by the flat surface 26, and a second part, facing towards the motor, and delimited by the curved central surface 24. The second part of the duct has a larger cross section than the first, according preferential passage to the fluid towards the motor. As shown in the drawing, the orifice 4 letting gas into the casing opens into the part of the duct of larger cross section, the inclined zone 25 connecting the sections being offset towards the compression stage with respect to the inlet orifice.

The deflector 18 is equipped, at its compression stage end 27, with a L-shaped return 28 which deflects the stream of gas through 180°. The end 29 of the return 28 is located, as shown in the drawing, approximately in the same place as the upper edge of the duct formed by the deflector 18. The return 28 is dimensioned in such a way that the passage cross section for the gas remains practically constant, the outlet cross section at the edge 29 being approximately equal to the passage cross section between the flat central surface 26 and the casing of the compressor.

In so far as the steam of gas is deflected through 180° as it leaves the deflector, it returns to the centre of the suction chamber 3 where it becomes laden with oil particles. For its part, the gas which is deflected towards the bottom by the deflector 18 passes into the lower part of the suction chamber 3 where it too becomes laden with oil particles. Thus, the gas delivered to the two suction orifices of the suction stage is laden with more or less the same amount of oil, in sufficient quantity to seal the compression pockets at the functional clearances that there are between the stationary part and the moving part of the compression stage.

As emerges from the foregoing, the invention provides a great improvement to the prior art by supplying a device of a simple structure which insures a uniform distribution of oil particles in the gas feeding the various suction orifices of the compression stage.

As goes without saying, the invention is not restricted to the single embodiment of this device which has been described hereinabove by way of example; on the contrary, it encompasses all alternative forms thereof. Thus, in particular, the shape of the upper part of the deflector could be different, the deflector could have a constant cross section along its entire length, the deflector could be made in several parts, or alternatively, the duct could be formed of a cavity or recess made in the inner face of the shell of the compressor, without in any way departing from the scope of the invention.

What is claimed is:

1. A scroll compressor having a cylindric hermetically closed shell, a suction chamber within the shell, a scroll mechanism in the shell, lubrication mist generating elements, a suction gas inlet opening radially into the suction chamber and a deflector plate in overlying relationship with the suction gas inlet and cooperating with the shell to delimit a duct having at least an upper opening feeding suction gas to the scroll mechanism, the upper opening being shaped to deflect suction gas into a region within the suction chamber where an oil mist is generated by said mist generating elements during operation.

2. Scroll compressor according to claim 1, in which the oil mist is generated by a counterweight secured to the shaft of the motor and located in the suction chamber.

3. Scroll compressor according to claim 1, in which the deflector has a compression stage end which has an L-shaped return which deflects the stream of gas through 180°.

4. Scroll compressor according to claim 3, in which the L-shaped return has an end which is located approximately in the same plane as the upper edge of a duct formed by the deflector.

5. Scroll compressor according to claim 1, in which the deflector includes a part of overall Ω-shaped cross section, the part having flanges used for securing it to an internal face of the shell approximately parallel to the axis of the compressor, and the part having a body which delimits the duct conveying the gas towards the inside of the suction chamber.

6. Scroll compressor according to claim 1, in which the duct delimited by the deflector is also delimited by a recess made in the inner face of the shell of the compressor.

7. Scroll compressor according to claim 1, in which the duct has an upper opening and a lower opening and comprises two parts, one of which faces towards the compression stage and has a smaller cross section than the other part which faces towards the motor.

8. Scroll compressor according to claim 7, in which the gas inlet orifice opens into the part of the duct of larger cross section facing towards the motor, and having a section-reducing zone providing a transition between the two parts of the duct being offset towards the compression stage with respect to the inlet orifice.

9. Scroll compressor according to claim 7, in which, in its small cross section zone facing towards the compression stage, the deflector has a flat central surface and, in its large cross section zone facing towards the motor, the deflector has a central surface in the shape of a portion of a cylindrical surface.

10. Scroll compressor according to claim 5, in which the deflector has a length such that the deflector extends on each side of the inlet orifice over a distance at least equal to the diameter of the inlet orifice.

* * * * *